United States Patent [19]

Sugimoto et al.

[11] Patent Number: 4,713,318

[45] **Date of Patent: * Dec. 15, 1987**

[54] CORE/SHELL SILVER HALIDE PHOTOGRAPHIC EMULSION AND METHOD FOR PRODUCTION THEREOF

[75] Inventors: Tadao Sugimoto; Toshiaki Hayakawa, both of Kanagawa, Japan

[73] Assignee: Fuji Photo Film Co., Ltd., Kanagawa, Japan

[ * ] Notice: The portion of the term of this patent subsequent to Sep. 30, 2003 has been disclaimed.

[21] Appl. No.: 690,356

[22] Filed: Jan. 10, 1985

[30] Foreign Application Priority Data

Jan. 12, 1984 [JP] Japan ..... 59-4017

[51] Int. Cl.[4] ..... G03C 1/02

[52] U.S. Cl. ..... 430/567; 430/569

[58] Field of Search ..... 430/567, 569

[56] References Cited

U.S. PATENT DOCUMENTS 3,935,014 1/1976 Klötzer et al. ..... 430/567
4,210,450 7/1980 Corben ..... 430/567
4,444,877 4/1984 Koitabashi et al. ..... 430/569
4,477,564 10/1984 Cellone et al. ..... 430/567
4,614,711 9/1986 Sugimoto et al. ..... 430/567

OTHER PUBLICATIONS

Hirsch "Photographic Emulsion Grains with Cores", Journal of Photo Science, vol. 10, 1962, pp. 129–146.

*Primary Examiner*—Richard L. Schilling
*Attorney, Agent, or Firm*—Sughrue, Mion, Zinn, Macpeak & Seas

[57] ABSTRACT

A silver halide photographic emulsion and a method for production thereof are described, said emulsion comprising silver halide grains which are comprised of silver iodobromide and have a multilayer structure formed from a core and at least one covering layer and an aspect ratio below 5, said silver halide grains being chemically sensitized and having a halogen composition such that the difference in average iodide content beween adjacent layers, each of which has a substantially homogeneous iodide distribution, is not less than 10 mol %, and the iodide content in the outermost layer is not more than 40 mol %.

14 Claims, No Drawings

CORE/SHELL SILVER HALIDE PHOTOGRAPHIC EMULSION AND METHOD FOR PRODUCTION THEREOF

FIELD OF THE INVENTION

The present invention relates to a silver halide emulsion and a method for production thereof.

BACKGROUND OF THE INVENTION

In general, various kinds of mechanical stresses are applied to a photographic material obtained by coating a silver halide emulsion. For instance, negative photographic films are bent when rolled up into a film cartridge or charged in a camera, and they are pulled at the time of frame traveling.

On the other hand, in case of photographic films having a sheet form, such as those for graphic arts, those for direct radiography employed for medical use and so on, it frequently occurs that the photographic films are folded or bent because they are handled directly by the hands.

In addition, great stresses are imposed on all sensitive materials by cutting and processing operations.

When various stresses are applied to a photographic material as described above, the stresses are imposed on silver halide grains through the gelatin medium which is typically the binder for the silver halide grains or through a plastic film which forms a support therefor. The stresses imposed on silver halide grains are known to cause changes in photographic properties of the photographic material. Details of such changes in photographic properties as caused by applied stresses are reported, for example, in K. B. Mather, *J. Opt. Soc. Am.*, Vol. 38, p. 1054 (1948); P. Faelens and P. de Smet, *Sci. et Ind. Phot.*, Vol. 25, No. 5, p. 178 (1954); P. Faelens, *J. Phot. Sci.*, Vol. 2, p. 105 (1954); and so on.

Of these changes in photographic properties, a phenomenon called "stress marks" tends to adversely affect the image quality of the photograph. In the case of X-ray sensitive materials, for example, this phenomenon can involve the danger of erroneous diagnoses.

Therefore, the advent of photographic materials that do not generate stress marks even if the foregoing stresses are applied thereto has been strongly desired.

As means for attempting to solve the above-described problem, some methods as described below have so far been considered.

For example, a method of making it difficult for pressure to reach silver halide grains by incorporating a plasticizer used for polymers or emulsions, or by lessening the silver halide to gelatin ratio in the silver halide emulsion, has been known as the means for improving the pressure-sensitivity characteristics.

More specifically, methods of using, as the plasticizer, a heterocyclic compound in British Patent No. 738,618, an alkyl phthalate in British Patent No. 738,637, an alkyl ester in British Patent No. 738,639, a polyhydric alcohol in U.S. Pat. No. 2,960,404, a carboxyalkyl cellulose in U.S. Pat. No. 3,121,060, paraffin and a carboxylic acid salt in Japanese Patent Application (OPI) No. 5017/74 (the term "OPI" as used herein refers to a "published unexamined Japanese patent application"), and an alkylacrylate and an organic acid in Japanese Patent Publication No. 28086/78, respectively, have been disclosed.

However, the method of adding such plasticizers as described above is attended with a lowering of the mechanical strength of the resulting emulsion layer and, therefore, there is a practical upper limit to the usable amount of the plasticizer. Furthermore, the method of increasing the content of gelatin is attended by a decrease in the development processing rate. For the above-described reasons and others, none of the foregoing methods can produce completely satisfactory effects. Accordingly, it is desired that the silver grains per se should acquire the property of being resistant to generating stress marks.

However, there are no descriptions of methods for making such an improvement with respect to pressure marks in the foregoing various literatures relating to stress. Also, Japanese Patent Application (OPI) No. 9137/83 and so on have described that desensitization due to applied pressure is caused by using silver iodobromide grains which are produced by growing silver iodobromide grains to have layers of different iodine mol fractions, but no descriptions of improvements in stress marks.

With respect to silver halide grains having a multilayer structure, silver halide grains having a triple-layer structure consisting of AgBr/AgBrI (I=18 or 32 mol %)/AgBr are described in *J. Photo. Sci.*, Vol. 24, p. 198 (1976). Therein, although the matter of the influence which the triple-layer structure has on the developability and the covering power was raised, there is no description of stress marks therein, nor any consideration regarding stress marks, because the silver halide grains used therein were not chemically sensitized.

In addition, silver halide grains having a multilayer structure prepared using an iodine conversion method have been proposed in U.S. Pat. No. 4,210,450. Such grains have an outermost layer having a high iodide content of 95 mol % or more, since iodide conversion is necessarily conducted in the final part of process of preparation. Therefore, such grains are undesirable in terms of stress marks.

Moreover, a highly sensitive photographic emulsion containing silver halide grains constructed by at least three silver iodobromide phases differing in iodide content, in which the overall iodide content is at least 12 mol %, and a preparation method therefor are described in Japanese Patent Application (OPI) No. 181037/83. According to the preparation method proposed by said patent application, however, homogeneous iodide distribution in each phase cannot be achieved. Also, no description with respect to the problem of stress marks is presented therein.

On the other hand, enhancement of developing activity and increases in sensitivity have been aimed at by using laminate type silver halide grains in which two or more shells are laminated on the surface of a core, as described in Japanese Patent Application (OPI) No. 22408/78, Japanese Patent Publication No. 13162/68, *J. Photo. Sci.*, Vol. 24, p. 198 (1976), and so on.

However, the silver halide grains prepared for the above-described aims do not always improve the stress characteristics, and the stress mark problem still remains largely unsolved. For example, multilayered silver halide grains consisting of pure silver bromide (core)/silver iodobromide (iodide content: 1 mol %)/pure silver bromide are described in Japanese Patent Application (OPI) No. 22408/78. However, those grains generate intense pressure marks, and thus from the viewpoint of pressure characteristic they have a problem analogous to that of conventional silver iodobromide emulsions having completely homogeneous iodine distribution.

Furthermore, it is noted that the pressure marks show up as photographic fog in a negative silver halide emulsion, whereas in a positive silver halide photograph they show themselves in the lowering of optical density (because the fog generates inside the grains).

SUMMARY OF THE INVENTION

Therefore, a primary object of the present invention is to provide a silver halide photographic emulsion which overcomes the above-described problems.

Another object of the present invention is to provide a silver halide photographic emulsion which is resistant to the generation of fog when stresses are imposed thereon.

It has now been found that above-described objects can be attained with a silver halide photographic emulsion comprising silver halide grains which are comprised of silver iodobromide and have a multilayer structure formed by a core and at least one covering layer and an aspect ratio below 5, with the silver halide grains being chemically sensitized and having such a halogen composition that a difference in average iodide content between any two adjacent layers, each of which has a substantially homogeneous iodide distribution, is not less than 10 mol %, and the iodide content of the outermost layer is not more than 40 mol %.

DETAILED DESCRIPTION OF THE INVENTION

Silver halide grains having a multilayer structure are those provided with one or more of a covering layer having an arbitrary halogen composition surrounding the core thereof. The covering layer may be either a single layer or a laminate constructed by two, three, four or more layers. Preferably, it is constructed of not more than five layers.

Silver halides which may be present in the core and the covering layers include silver bromide, silver iodobromide, and silver iodide. Also, they may be mixed with a small amount of silver chloride. Specifically, they may contain not more than about 10 mol %, and preferably not more than about 5 mol %, silver chloride.

The outermost layer is comprised of silver bromide or silver iodobromide, but having an iodide content of 40 mol % or less, and may contain less than several percent of chloride.

The silver halide grain of the present invention as a whole has an average iodide content of preferably 10 mol % or less, and more preferably 6 mol % or less.

Since iodide sometimes aggravates the development inhibition problem, the infectious development problem and so on, for example, in X-ray sensitive materials, it is desired from the practical point of view that the iodide content should preferably be controlled so as not to exceed a moderate limit. Although the present invention can produce a stress mark decreasing effect regardless of the iodide content of the silver halide grains, a suitable average iodide content in the grain as a whole is not more than 10 mol %, preferably not more than 6 mol %, and particularly preferably is not more than 3 mol %, for the above-described reason.

When the core of the silver halide grain of the present invention is comprised of silver iodobromide, it is preferred for the core to form a homogeneous solid solution phase.

More concrete explanation for the expression "homogeneous" in the present invention is given below.

That is to say, as defined in Japanese Patent Application (OPI) No. 110926/81, the expression "homogeneous" means that when the powder X-ray diffraction analysis of silver halide grains is carried out using X-ray of Cu-K$\alpha$, a half width ($\Delta 2\theta$) of the peak corresponding to the plane index [2,0,0] of silver iodobromide is below 0.30 (deg). The condition under which the diffractometer is used for the above-described analysis is $\omega\tau/\gamma \leqq 10$, wherein the scanning speed of a goniometer is represented by $\omega$ (deg/min), the time constant is represented by $\tau$ (sec), and the receiving slit width is represented by $\gamma$ (mm).

A preferred halogen composition of the core is not more than 40 mol % iodide on the average, and more preferably is from 0 to 20 mol % iodide.

The difference in silver iodide content between adjacent layers (i.e., any two adjacent covering layers, or the core and the adjacent covering layer) is not less than 10 mol %, preferably not less than 20 mol %, and particularly preferably not less than 35 mol %.

A silver iodide content in covering layers other than the outermost covering layer is preferably from 10 to 100 mol %.

In the case wherein the silver halide grain is constructed of three or more layers, and all covering layers are constituted with silver iodobromide, it is desirable that all layers are homogeneous silver iodobromide, though it is not always necessary for all layers to be homogeneous.

A layer having a high iodide content as described above (including the core) is preferably present below the outermost layer in the case of negative silver halide emulsion, whereas in the case of positive silver halide emulsion it may be present either inside of the grain or at the surface of the grain.

It is necessary that a silver iodide content in the outermost covering layer is not more than 40 mol %. Preferably, it is from 0 to 10 mol %.

The iodide content in the core and the covering layers of the silver halide grains of the present invention can be determined using methods as described, for example, in the article entitled "X-Ray Analysis in TEM-/ATEM" by J. I. Goldstein & D. B. Williams, published in *Scanning Electron Microscopy* (1977), Vol. 1, p. 651, IIT Research Institute (March, 1977).

When the silver halide grains of the present invention have a double layer structure, it is desirable that the core has a higher iodide content than the outermost layer. And when they have a triple layer structure, the covering layer other than the outermost layer or the core has preferably a higher iodide content than the outermost layer.

It is necessary for the silver halide grains of the present invention to be chemically sensitized. If the silver halide grains are unsensitized, it is unnecessary for the grains to possess such characteristics as the silver halide grains of the present invention possess, because their sensitivity is low by nature and they are not readily subject to the occurrence of stress marks.

The silver halide grains of the present invention may be either negative or positive.

When they are negative, it is desirable that the silver halide grains of the present invention are chemically sensitized to such an extent that optical density may become not less than 60% on the optimum degree of sensitization in case of taking the sensitivity point of fog+0.1.

When they are positive, it is desirable that the interior of the grains is chemically sensitized to such an extent that optical density may become not less than 60% of the highest degree of sensitization in the case of taking the sensitivity point of maximum density, 0.1.

The size of the silver halide grains as described herein is represented by a projection area diameter. Herein, the term projection area diameter refers to the diameter of the circle having the same area as the projected area of the grain.

The silver halide grains of the present invention has a size of from 0.5 to 10 μm, preferably from 0.5 to 5.0 μm, and more preferably from 1.0 to 3.0 μm.

An aspect ratio, that is, a ratio of a projection area diameter to a thickness, is controlled to less than 5. Herein, the thickness refers to the shortest distance across of those passing through the center of gravity of the grain.

The silver halide grains of the present invention may have any crystal forms, provided that they have an aspect ratio less than 5. They may be single crystal grains having an octahedral structure, a cubic structure, a tetradecahedral structure or so on; or polytwinned crystal grains having various forms. The crystal forms thereof may be a sphere, a plate, and so on.

The silver halide grains of the present invention are not particularly limited with respect to size distribution, but preferably are monodisperse. The terminology "monodisperse system" as used herein refers to a disperse system wherein 95% of the grains have their individual sizes within the range of ±60% of the number average grain diameter, and preferably within ±40%. Herein, the term "number average grain diameter" refers to the number average diameter based on projection area diameters of the grains.

A proportion of the silver halide grains of the present invention to the whole silver halide grains present in the emulsion layer containing said grains is, though it may be selected arbitrarily, preferably controlled to 40% or more, and particularly preferably to 90% or more, on the basis of the silver content.

Silver halide photographic emulsions having a multilayer structure which are to be employed in the present invention are described in detail, e.g., in U.S. Pat. Nos. 1,027,146, 2,592,250 and 4,210,450, *J. Photo. Sci.*, Vol. 24, p. 198 (1976), and so on, and can be prepared using any methods described in the above-described literatures.

In general, the silver halide photographic emulsions of the present invention can be made as follows.

That is, core grains constituted with silver halide are formed in a conventional manner and then covering layers constituted with silver halides are formed on the individual surfaces of the core grains according to a halogen conversion method or a covering method.

When only one covering layer is formed, it is necessary that an iodide content in the covering layer is controlled to 40 mol % or below, and the difference in the iodide content between the core and the covering layer is adjusted to 10 mol % or more.

When two or more covering layers are formed, it is necessary to take into account the manner and the quantities of adding a nitrate and/or halides so that an iodide content in the outermost covering layer may be controlled to 40 mol % or less, and that the difference in iodide content between the core and the adjacent covering layer or between two adjacent convering layers differing in halogen composition may be adjusted to 10 mol % or more.

More specifically, preparation processes are illustrated below.

First of all, core of the silver halide grains of the present invention can be prepared using methods as described in P. Glafkides, *Chimie et Physique Photographique*, Paul Montel, Paris (1967); G. F. Duffin, *Photographic Emulsion Chemistry*, The Focal Press, London (1966); and V. L. Zelikman et al., *Making and Coating Photographic Emulsion*, The Focal Press, London (1964), and so on. Namely, an acid process, a neutral process, an ammonia process and other conventional processes may be employed, and suitable methods for reacting a water-soluble silver salt with a water-soluble halide include a single jet method, a double jet method and a combination thereof.

Also, a method in which silver halide grains are produced in the presence of excess silver ion (the so-called reversal mixing method) can be employed in the present invention. On the other hand, the so-called controlled double jet method, in which the pAg of the liquid phase in which silver halide grains are to be precipitated is maintained constant, may be also employed therein. According to this method, a silver halide emulsion which contains the grains having a regular crystal form and is nearly uniform in grain size can be obtained.

Two or more kinds of silver halide emulsions prepared separately may be used as a mixture.

It is desirable for the core grains of the silver halide grains of the present invention to be so prepared as to have a uniform halogen composition. When the core grains are to be constituted of silver iodobromide, a double jet method or a controlled double jet method is preferably employed upon the preparation of the core grains.

A generally suitable pAg at the time of preparing the core grains is, though optionally depending upon a reaction temperature used and the silver halide solvent used, within the range of from 7 to 11. In addition, it is advantageous to use a silver halide solvent for the reason that a time for grain formation can be reduced. Suitable examples of silver halide solvents which can be used include ammonia and thioether, and other known silver halide solvents.

The core grains may have any crystal form, such as that of a plate, a sphere, a twinned structure or so on, a regular crystal form, such as that of an octahedral, a cube, a tetradecahedral or so on; or a composite form thereof.

Moreover, the core may be either a polydisperse or a monodisperse system. However, it is much more preferable for the core grains to be a monodisperse system. Herein, the term "monodisperse" has the same meaning as described above.

In order to render the grain size uniform, it is desirable to use methods, e.g., as described in British Patent No. 1,535,016, Japanese Patent Publication Nos. 36890/73 and 16364/77, and so on, in which addition rates of a water solution of silver nitrate and a water solution of an alkali halide are changed depending upon the grain growth rate; and methods as described in U.S. Pat. No. 4,242,445, Japanese Patent Application (OPI) No. 158124/80, and so on, in which the grain growth is hastened below the critical point of supersaturation using the method of changing concentrations of water solutions used. These methods do not cause re-nucleation and enable uniform covering on individual silver halide grains. Therefore, they can be also used to advantage in introducing covering layers described hereinafter.

In a process for producing the core grains of the silver halide grains of the present invention or allowing the produced core grains to ripen physically, cadmium salts, zinc salts, lead salts, thallium salts, iridium salts or complexes, rhodium salts or complexes, iron salts or complexes and/or the like may be present.

Covering layers for silver halide grains of the present invention can be provided for the core grains formed by using a known halide conversion method or silver halide covering method, after optional removal of soluble salts.

The halogen conversion can be effected, e.g., by adding a water solution containing principally an iodine-containing compound (especially potassium iodide) in a concentration of preferably 10% or less, after formation of the core grains. Further details of methods usable for the halogen conversion are described, e.g., in U.S. Pat. Nos. 2,592,250 and 4,075,020, Japanese Patent Application (OPI) No. 127549/80, and so on. In order to diminish differences in iodide distribution among covering layers provided on individual core grains upon the halogen conversion, it is advisable to control a concentration of an aqueous iodine compound solution to $10^{-2}$ mol % or below and to add the solution over not less than a 10 minute period.

On the other hand, silver halide can be newly provided on the individual core grains as a covering layer, e.g., by adding a water solution of halide and a water solution of silver nitrate at the same time, that is to say, using a double jet method or a controlled double jet method. More specifically, the formation of such a covering layer as described above can be effected using methods as described in Japanese Patent Application (OPI) No. 22408/78, Japanese Patent Publication No. 13162/68, *J. Photo. Sci.*, Vol. 24, p. 198 (1976), and so on.

At this time, an aqueous halide solution which contains an iodine-containing compound in an amount equimolar or higher (up to double the molar amount) with silver nitrate which is employed in a fraction of from 0.01 to 30 mol % to the mol number of silver contained in the finished grains as a whole, and optionally an aqueous solution of halide, for example, bromide is added.

The optimum pAg value changes depending upon the reaction temperature, and the kind and the amount of silver halide solvent used. However, the values described hereinbefore can be similarly employed.

Upon formation of a covering layer, it is more preferable to use a double jet method or a controlled double jet method.

At the time of introduction of another covering layer having a different halogen composition, it is necessary to take into account the change in critical point of supersaturation, for a covering layer to be newly provided is difficult to be deposited on the previously provided covering layer. In addition, it is desirable to increase the molar quantities added per unit time with an increase in the whole surface area of the grains.

In the case wherein the newly provided covering layer is silver bromide, a method of adding a water solution of silver nitrate to an aqueous bromide solution in which core grains provided with a covering layer is present in advance (that is, a single jet method) can be also employed.

In the case wherein the silver halide grains of the present invention are positive (internally sensitized) silver halide grains in particular, the following methods can be used for the formation thereof. For instance, one method involves making a conversion emulsion (as described in U.S. Pat. No. 2,592,250) which utilizes the catastrophic precipitation process comprising forming at first highly soluble silver halide grains like silver chloride grains, and then converting into a silver salt having low solubility such as silver (iodo)bromide; another method involves making a core/shell emulsion in which a chemically sensitized core emulsion containing very coarse grains is blended with a very fine grain silver halide emulsion, and this mixture is ripened for an appropriate period to form a shell arising from the fine grained silver halide on the surface of the core grain (as described in U.S. Pat. No. 3,206,313 and British Patent No. 1,011,062); a third method involves making a core/-shell emulsion in which a solution of soluble silver salt and a solution of soluble halides are simultaneously added to a chemically sensitized monodisperse core emulsion as a silver ion concentration is maintained constant, whereby the surface of the core grain is covered with a silver halide shell (as described in British Patent No. 1,027,146 and U.S. Pat. No. 3,761,276); a further method involves making an emulsion having a multilayered particle in which the emulsion grains have not less than two laminated structures, and the first phase differs in halogen composition from the second phase (as described in U.S. Pat. No. 3,935,014); still another method involves making an emulsion which contains a foreign metal inside the grains by producing silver halide grains in an acidic medium containing trivalent metal ion (as described in U.S. Pat. No. 3,447,927). In addition, silver halide grains of positive type which can be used in the present invention can be prepared using methods as described in E. J. Wall, *Photographic Emulsions*, pp. 35–36 and pp. 52–53, American Photographic Publishing Co. (1929), U.S. Pat. Nos. 2,497,875, 2,563,785 and 3,511,662, German Patent Application (OLS) No. 2,728,108 and so on. Moreover, the positive silver halide grains can be also prepared using the internal sensitizing method described in U.S. Pat. No. 3,761,276.

A homogeneous core or covering layer to be employed in the present invention can be easily prepared using known methods. Suitable examples of such methods include a simultaneous mixing method, a double jet method, a controlled double method, a silver halide solvent-utilizing method and so on.

In the course of preparing the silver halide grains of the present invention, soluble salts are removed from the emulsion after the formation of the outermost covering layer or the physical ripening thereof, and, if desired, after the formation of the core grains or each of the covering layers. The removal can be effected using the noodle washing method which comprises gelling the gelatin or using a sedimentation process (thereby causing flocculation in the emulsion) taking advantage of a sedimenting agent such as an inorganic salt, an anionic surface active agent, an anionic polymer (e.g., polystyrenesulfonic acid), or a gelatin derivative (e.g., an acylated gelatin, a carbamoylated gelatin, etc.).

In the silver halide emulsion of the present invention, the surface of the silver halide grains and/or the core thereof, or inner covering layers, are chemically sensitized. Chemical sensitization can be carried out using processes described in, for example, H. Frieser, *Die Gundlagen der Photographischen Prozesse mit Silberhalogeniden,* pp. 675–734, Akademische Verlagsgesellschaft (1968).

More specifically, sulfur sensitization using compounds containing sulfur capable of reacting with silver ion, or active gelatin, reduction sensitization using reducing materials, noble metal sensitization using gold and other noble metal compounds, and so on can be employed individually or as a combination thereof. Examples of suitable sulfur sensitizers which can be used include thiosulfates, thioureas, thiazoles, rhodanines and other sulfur-containing compounds, and specific examples of such sulfur sensitizers are disclosed, e.g., in U.S. Pat. Nos. 1,574,944, 2,410,689, 2,278,947, 2,728,668, 3,656,955, 4,032,928, and 4,067,740. Examples of reducing sensitizers which can be used include stannous salts, amines, hydrazine derivatives, formamidine sulfinic acid, silane compounds and so on, and specific examples of these sensitizers are described, e.g., in U.S. Pat. Nos. 2,487,850, 2,419,974, 2,518,698, 2,983,609, 2,983,610, 2,694,637, 3,930,867 and 4,054,458. Group VIII metal complexes such as those of platinum, iridium, palladium, etc., other than gold metal complexes, can be employed for the purpose of sensitization with a noble metal. Specific examples of these metal complexes are described in U.S. Pat. Nos. 2,399,083 and 2,448,060, British Patent No. 618,061, and so on.

The silver salt grains of the present invention can be chemically sensitized using a combination of two or more of the above-described methods.

The photographic emulsion of the present invention may be coated at any silver coverage. A preferred coverage of silver ranges from 1,000 mg/m$^2$ to 15,000 mg/m$^2$, and particularly preferred range is from 2,000 mg/m$^2$ to 10,000 mg/m$^2$.

The sensitive layer containing the silver halide grains according to the present invention may be present on both sides of the support.

As for the binder or the protective colloid of the photographic emulsion of the present invention, gelatin is used to advantage. Of course, other hydrophilic colloids can be also used.

Specific examples of hydrophilic colloids which can be used include proteins such as gelatin derivatives, graft copolymers prepared from gelatin and other high polymers, albumin, casein, etc.; sugar derivatives such as cellulose derivatives (e.g., hydroxyethyl cellulose, carboxymethyl cellulose, cellulose sulfate, etc.), sodium alginate, starch derivative, etc.; and various kinds of synthetic hydrophilic macromolecular substances such as homo- or copolymers including polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole and the like.

Gelatin which can be used includes not only lime-processed gelatin, but also acid-processed gelatin and enzyme-processed gelatin, as described, e.g., in *Bull. Soc. Sci. Phot. Japan,* No. 16, p. 30 (1966). In addition, hydrolysis products of gelatin and enzymatic degradation products of gelatin can also be used. Examples of gelatin derivatives which can be used include those obtained by reaction of gelatin with various kinds of compounds such as acid halides, acid anhydrides, isocyanates, bromoacetic acid, alkanesultones, vinylsulfonamides, maleimide compounds, polyalkylene oxides, epoxy compounds and so on.

The photographic emulsion of the present invention can contain a wide variety of compounds for purposes of preventing fog or stabilizing photographic functions during production, storage, or photographic processing, including azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), and so on; mercaptopyrimidines, mercaptotriazines; thicketo compounds like oxazolidine thione; azaindenes such as triazaindenes, tetraazaindenes (especially 4-hydroxy-substituted (1,3,3*a*,7)tetraazaindenes), pentaazaindenes, and so on; and compounds which have been known as antifoggants or stabilizers, such as benzenethiosulfones, benzenesulfinic acid, benzenesulfonic acid amide, and so on can be added to the photographic emulsion.

The photographic emulsion layers and other hydrophilic colloid layers of the photosensitive material having the photographic emulsion of the present invention may contain various kinds of surface active agents for a wide variety of purposes, for instance, as a coating aid, prevention of generation of static charges, improvement in slippability, emulsifying dispersion, prevention from the generation of adhesion, improvements in photographic characteristics (e.g., acceleration of development, increase in contrast, sensitization, etc.) and so on.

Examples of suitable surface active agents include nonionic surface active atents such as saponin (steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamines or amides, polyethylene oxide adducts of silicone, etc.), glycidol derivatives (e.g., alkenylsuccinic acid glyceride, alkylphenol polyglyceride, etc.), fatty acid esters of polyhydric alcohols, alkyl esters of sugars, and so on; anionic surface active agents containing acid groups such as a carboxyl group, a sulfo group, a phospho group, a sulfate group, a phosphate group, etc., for example, alkyl carboxylates, alkyl sulfonates, alkylbenzenesulfonates, alkylnaphthalenesulfonates, alkylsulfates, alkyl phosphates, N-acyl-N-alkyltaurines, sulfosuccinic acid esters, sulfoalkylpolyoxyethylene alkyl phenyl ethers, polyoxyethylene alkylphosphoric acid esters and so on; amphoteric surface active agents such as amino acids, aminoalkylsulfonic acids, aminoalkylsulfuric acid or phosphoric acid esters, alkylbetaines, amine oxides and so on; and cationic surface active agents such as alkylamine salts, aliphatic or aromatic quaternary ammonium salts, heterocyclic quaternary ammonium salts such as pyridinium, imidazolium and like salts, aliphatic or heterocyclic phosphonium or sulfonium salts, and so on.

The photographic emulsion of the present invention may be spectrally sensitized using methine dyes or others. These sensitizing dyes may be employed individually or in combination. Combinations of sensitizing dyes are often employed for the purpose of supersensitization. Materials which can exhibit a supersensitizing effect in combination with a certain sensitizing dye, although they themselves do not spectrally sensitize silver halide emulsions or do not absorb light in the visible region, may be incorporated in the emulsion.

Useful sensitizing dyes, typical supersensitizing combinations and materials capable of exhibiting a supersensitizing effect are described, e.g., in *Research Disclosure,* Vol. 176, No. 17643, p. 23, item IV-J (Dec. 1978).

Photographic emulsions and other hydrophilic colloid layers of the photographic material in which the photographic emulsion of the present invention is used can contain inorganic or organic hardeners. Suitable examples of hardeners which can be used include chromium salts (e.g., chrome alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,4-dihydroxydioxane, etc.), active vinyl-containing compounds (e.g., 1,3,5-triacryloyl-hexahydro-s-triazine, 1,3-vinylsulfonyl-2-propanol, etc.), active halogen-containing compounds (e.g., 2,4-dichloro-6-hydroxy-s-triazine, etc.), halocarboxyaldehydes (e.g., mucochloric acid, mucophenoxychloric acid, etc.), and so on. These hardeners can be used alone or in combination.

Photographic emulsion layers and other hydrophilic colloid layers of the photographic material in which the photographic emulsion of the present invention is used can contain water-insoluble or slightly soluble synthetic polymers dispersed in latex form, for the purpose of improvement in dimensional stability and anti-kinking so on. Suitable examples of such polymers include those containing as constituent monomers an alkyl(meth)acrylate, an alkoxyalkyl(meth)acrylate, a glycidyl(meth)acrylate, a (meth)acrylamide, a vinyl ester (e.g., vinyl acetate), an acrylonitrile, an olefin, a styrene and so on individually or in combination of two or more thereof, or in combination of one or more of the above-described monomer with acrylic acid, methacrylic acid, an $\alpha,\beta$-unsaturated dicarboxylic acid, a hydroxyalkyl(meth)acrylate, a sulfoalkyl(meth)acrylate, a styrenesulfonic acid, and so on.

Photographic emulsion layers of the photographic material in which the photographic emulsion of the present invention is used may contain color forming couplers, that is to say, compounds capable of forming colors by oxidative coupling with aromatic primary amine developing agent (e.g., phenylenediamine derivatives, aminophenol derivatives, etc.) upon color development processing. Specific examples of magenta couplers which can be used include 5-pyrazolone couplers, pyrazolobenzimidazole couplers, cyanoacetylcumarone couplers, open chain acylacetonitrile couplers and so on. Specific examples of yellow couplers which can be used include acylacetamide couplers (e.g., benzoylacetanilides, pivaloylacetanilides, etc.), and so on. Specific examples of cyan couplers include naphthol couplers, phenol couplers and so on. Of these couplers, nondiffusible couplers which contain a hydrophobic group as a so-called ballast group in a molecule are more advantageous. The couplers may be either 4-equivalent or 2-equivalent with respect to silver ions. In addition, colored couplers which have a color correcting effect, and couplers capable of releasing development inhibitors upon development (so-called DIR couplers) may be incorporated in the photographic emulsion layers. Besides DIR couplers, colorless DIR coupling compounds which form colorless products upon the coupling reaction and release development inhibitors can also be incorporated.

In the present invention, known discoloration inhibitors can be used. The discoloration inhibitors which can be used in the present invention can be used alone or in combinations of two or more thereof. Specific examples of known discoloration inhibitors include hydroquinone derivatives, gallic acid derivatives, p-alkoxyphenols, p-oxyphenol derivatives, and bisphenols.

Hydrophilic colloid layers of a photosensitive material prepared using the photographic emulsion of the present invention may contain an ultraviolet absorbing agent. For example, aryl-substituted benzotriazole compounds, 4-thiazolidone compounds, benzophenone compounds, cinnamate compounds, butadiene compounds, benzoxazole compounds, and ultraviolet absorbing polymers can be used as the ultraviolet absorbing agent. These ultraviolet absorbing agents may be fixed inside the above-described hydrophilic colloid layers.

The photosensitive material prepared in accordance with the present invention may contain water-soluble dyes as filter dyes, antihalation dyes, or dyes for various other purposes. Examples of dyes useful for the above-described purposes include oxonol dyes, hemioxonol dyes, styryl dyes, merocyanine dyes, cyanine dyes and azo dyes. Of these dyes, oxonol dyes, hemioxonol dyes and merocyanine dyes are used to greater advantage.

The photosensitive material prepared in accordance with the present invention may contain as a color fog inhibitor a hydroquinone derivative, an aminophenol derivative, a gallic acid derivative, an ascorbic acid derivative or so on.

The present invention can also be applied to a multilayer multicolor photographic material having at least two different color sensitivities on a support. A multilayer color photographic material has, in general, at least one red-sensitive emulsion layer, at least one green-sensitive layer and at least one blue-sensitive layer on a support. The order of these layers can be varied as desired. Usually, cyan-, magenta- and yellow-forming couplers are incorporated in red-, green-, and blue-sensitive emulsion layers, respectively. However, different combinations can also be employed, if desired.

In producing a photographic material in accordance with the present invention, photographic emulsion layers and other hydrophilic colloid layers can be coated on a support or other layers using various known coating methods. Suitable examples of coating methods which can be used include a dip coating method, a roller coating method, a curtain coating method, an extrusion coating method and so on. Of these methods, those described, e.g., in U.S. Pat. Nos. 2,681,294, 2,761,791 and 3,526,528 are used to advantage. Suitable examples of a support which can be used include cellulose ester film like cellulose triacetate film, polyester films like polyethylene terephthalate film, paper coated with an $\alpha$-olefin polymer, and so on.

The silver halide emulsion of the present invention can be used not only in black-and-white photosensitive materials such as sensitive materials for direct radiography and photofluorography, lithographic photosensitive materials, picture-taking black-and-white photosensitive materials, etc., but also in color photosensitive materials such as color negative photosensitive materials, color reversal photosensitive materials, color paper and so on.

Known processing methods and known processing solutions, as described, e.g., in *Research Disclosure,* Vol. 176 (1978), pp. 28–30 (RD-17643), can be employed in the photographic processing of the photosensitive material produced in accordance with the present invention. This photographic processing may be either a photographic processing for forming a silver image (black-and-white photographic processing) or a photographic processing for forming a dye image (color photographic processing), depending upon the end-use purpose of the photographic material. The processing temperature is generally in the range of from about 18° C. to about 50° C. Of course, temperatures higher than about 50° C. or lower than about 18° C. may be employed.

The developing solution employed for black-and-white photographic processing can contain known developing agents. Suitable developing agents include dihydroxybenzenes (e.g., hydroquinone), 3-pyrazolidones (e.g., 1-phenyl-3-pyrazolidone), aminophenols (e.g., N-methyl-p-aminophenol) and so on, and these can be used alone or in combination. The developing solution can generally contain, in addition to the above-described developing agents, known preservatives, alkali agents, pH buffering agents and antifoggants, and may optionally contain dissolving aids, toning agents, development accelerators, surface active agents, defoaming agents, water softeners, hardeners, viscosity increasing agents and so on.

Fixing solutions which can be used include those having conventionally used compositions.

Suitable fixing agents contained in the fixing solutions include thiosulfates, thiocyanates and other organic sulfur compounds which have been known to have a fixing effect.

The fixing solutions may contain a water-soluble aluminum salt as a hardener.

Dye images can be formed using conventional methods. For instance, a negative-positive process (as described in *Journal of the Society of Motion Picture and Television Engineers,* Vol. 61, pp. 667–701 (1953)); a color reversal process in which a negative silver image is formed by development with a developing solution containing a black-and-white developing agent, uniform exposure or another appropriate fogging treatment is, then, carried out at least once, and subsequently color development is carried out to provide a positive dye image; a silver dye bleach process in which dye-containing photographic emulsion layers are developed after exposure to produce a silver image, and the dyes are bleached using the resulting silver image as a bleaching catalyst; and so on can be employed.

A color developing solution is, in general, an alkaline aqueous solution containing a color developing agent. Suitable examples of color developing agents which can be used include known aromatic primary amine developers, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition to the above-described color developing agents, those described in L. F. A. Mason, *Photographic Processing Chemistry,* pp. 226–229, The Focal Press, London (1966), U.S. Pat. Nos. 2,193,015 and 2,592,364, Japanese Patent Application (OPI) No. 64933/73, and so on, may be also employed.

Besides color developing agents as described above, the color developing solution can contain a pH buffering agent, a developing inhibitor, an antifoggant, and so on. Optionally, a water softener, a preservative, an organic solvent, a development accelerator, dye forming couplers, competing couplers, a fogging agent, an auxiliary developer, a viscosity imparting agent, chelating agents of polycarboxylic acid type, an antioxidant, and so on may be contained in the color developing solution.

Photographic emulsion layers which have been color development processed are generally subjected to a bleach processing. The bleach processing may be carried out either simultaneously with or separately from a fix processing. Suitable examples of bleaching agents which can be used include compounds of polyvalent metals such as Fe (III), Co (IV), Cr (VI), Cu (II), etc., peroxy acids, quinones, nitroso compounds and so on.

To the bleaching bath or the bleach-fix bath may be added bleach accelerating agents as described, e.g., in U.S. Pat. Nos. 3,042,520 and 3,241,966, Japanese Patent Publication Nos. 8506/70 and 8836/70, and so on, thiol compounds described in Japanese Patent Application (OPI) No. 65732/78, and other various additives.

The present invention is illustrated in greater detail by reference to the following examples.

EXAMPLE 1

1. Preparation of Comparative Sample I-1

(1) Preparation of Silver Iodobromide Grains for Core (Phase-A)

To a mixture prepared by adding 30 g of gelatin, 8 g of potassium bromide and 80 cc of a 0.1% methanol solution of 3,4-dimethyl-4-thiazoline-2-thione to 1 liter of water which was placed in a vessel maintained at 75° C., 410 ml of a water solution containing 250 g/l of silver nitrate (Solution A) and 400 ml of a water solution containing 5 g/l of potassium iodide and 206 g/l of potassium bromide (Solution B) both were simultaneously added dropwise over a period of 30 minutes with stirring according to a double jet method as the pBr was kept at 1.41.

The thus obtained silver halide grains were silver iodobromide grains having an octahedral form, an iodide content of 2 mol %, and a size defined in terms of the projection area diameter (the same shall apply hereinafter) of 0.80 μm.

(2) Growth of Covering Layer (Phase-C)

To a mixture prepared by mixing a 28 g portion on a silver basis of the Phase-A emulsion prepared in the above-described Step (1) with 790 cc of water, 16 g of gelatin and 80 cc of a 0.1% methanol solution of 3,4-dimethyl-4-thiazoline-2-thione which was placed in a vessel maintained at 75° C., 670 cc of a 0.94 N $AgNO_3$ solution and a 1.09 N KBr solution both were added simultaneously with stirring in such amounts that the pBr of the resulting mixture was kept at 1.41 over a period of 50 minutes according to a double jet method. The thus obtained silver halide grains were monodisperse octahedral grains having a mean diameter of 1.45 μm, and had a core/shell structure constructed by the Phase-A and the Phase-C of pure silver bromide.

To the thus obtained silver halide emulsion were added $6\times10^{-6}$ mol/mol silver of chloroauric acid and $1.3\times10^{-5}$ mol/mol silver of sodium thiosulfate. The resulting emulsion was kept at 60° C. for 60 minutes to complete chemical ripening. Thereafter $3\times10^{-3}$ mol of 4-hydroxy-6-methyl-1,3,3*a*,7-tetraazaindene and a proper amount of coating aid were added to the chemically ripened emulsion. The resulting emulsion was coated on a PET film support at a coverage of 4 g/m², on a silver basis, to produce Comparative Sample I-1.

2. Preparation of Silver Halide Grains Differing Greatly in Iodide Content between Core and Shell (This Invention)

(1) Preparation of Silver Iodobromide Grains for Core

Two kinds of octahedral silver iodobromide grains, having iodide contents of 10 mol % and 40 mol %, respectively, were prepared in a similar manner as in the above-described Step 1-(1), except that the ratio of the potassium iodide concentration to the potassium bromide concentration in the water solution of alkali halides was changed as indicated below, and further, the amount of the methanol solution of 3,4-dimethyl-4-thiazoline-2-thione was controlled so that the grains formed might have the same size as those formed in Step 1-(1).

The samples of the present invention, I-2 and I-3, were produced using the thus prepared grains in the same manner as described in the above-described Step 1-(2).

3. Method for Evaluating Stress Characteristics

Each of the thus obtained sample films was bent under the atmosphere conditions of a relative humidity of 40% and a temperature of 25° C. The bending was achieved by bending the film at an angle of 180° along the circumference of an iron rod having a diameter of 6 mm. Just after the bending manipulation, the films were exposed through an optical wedge for $10^{-2}$ sec. The thus exposed samples were developed with the following surface developing solution at 20° C. for 10 minutes. The resulting samples were then fixed and washed.

| Composition of Surface Developing Solution | |
|---|---|
| Monomethyl-p-aminophenol Sulfate | 5 g |
| L-Ascorbic Acid | 20 g |
| Sodium Metaborate | 70 g |
| Potassium Bromide | 2 g |
| Water to make | 1 liter |

Herein, the ration of the quantity of the change in gog density due to the bending to the maximum denisty of the image formed, $\Delta Fog/D_m$, was employed as the criterion for stress characteristics. The results obtained were shown in Table 1.

TABLE 1

Relationship between Difference in Iodide Content between Core and Shell and $\Delta Fog/D_m$ (%)
Core Silver: Shell Silver = 1:5
Shell Composition: Pure Silver Bromide

| Sample | Iodide Content in Core (mol %) | Iodide Content in Shell (mol %) | Difference in Iodide Content | $\Delta Fog/D_m$ (%) |
|---|---|---|---|---|
| I-1 (Comparison) | 2 | 0 | 2 | 8.0 |
| I-2 (Invention) | 10 | 0 | 10 | 0.5 |
| I-3 (Invention) | 40 | 0 | 40 | 0 |

As can be seen from the results in Table 1, generation of fog due to stress was markedly inhibited when the difference in iodide content between the core and the shell was 10 mol % or above.

EXAMPLE 2

1. Preparation of Grains Having Shell in Which Halide Composition is 3 Mol % Iodide Three kinds of core grains were prepared in the same manner as employed in Steps 1-(1) and 2-(1) of Example 1, respectively. A covering layer was made to grow on each kind of core grains in a similar manner as employed in Step 1-(2) of Example 1 except that 670 cc of a water solution containing 7.5 g/l of potassium iodide and 203 g/l of potassium bromide was used in place of the 1.09 N KBr solution. Thus, monodisperse octahedral silver halide grains having a mean diameter of 1.45 μm were obtained.

The after-ripening and subsequent steps were carried out in the same manner as in Example 1, whereby samples for comparison, II-1 and II-2, and the sample of the present invention, II-3, were produced. These samples were examined for stress characteristics by carrying out the bending test described in Example 1. The data of $\Delta Fog/D_m$ determined by that test are shown in Table 2.

TABLE 2

Relationship between Difference in Iodide Content between Core and Shell and $\Delta Fog/D_m$ (%)
Core Silver: Shell Silver = 1:5
Shell Composition: AgBrI (I = 3 mol %)

| Sample | Iodide Content in Core (mol %) | Iodide Content in Shell (mol %) | Difference in Iodide Content (mol %) | $\Delta Fog/D_m$ (%) |
|---|---|---|---|---|
| II-1 (Comparison) | 2 | 3 | 1 | 7.5 |
| II-2 (Comparison) | 10 | 3 | 7 | 3.6 |
| II-3 (Invention) | 40 | 3 | 37 | 0 |

As can be seen from the results in Table 2, a sufficiently desirable decrease in fog due to stress was not caused in the case of Sample II-2 where the difference in iodide content was 7 mol %. On the other hand, no fog was generated by application of stress in the case of Sample II-3 produced in accordance with the present invention.

EXAMPLE 3

Application to Multiphase Structure

1. Introduction of High Iodide Content Phase Using Conversion Method

Samples were produced in a similar manner as Sample I-1 for comparison, except that before getting to the step for the growth of Phase-C, the first covering layer (Phase-B) was introduced by adding a water solution of KI in a quantity of 100 cc per 34 g of silver in the Phaase-A emulsion at 75° C. over a 10 minute period. The relationship between the proportion of the this formed first covering layer to the whole and the fog due to stress to shown in Table 3.

TABLE 3

Relationship between Mol Fraction of Silver in First Covering Layer (Phase-B) Introduced by Iodide Conversion and $\Delta Fog/D_m$ (%) Phase-A (core): AgBrI (I = 2 mol %), Phase-B: AgBrI (I > 95 mol %), and Phase-C: Pure AgBr

| Sample | Mol Fraction of Silver in Phase-B (%) | Maximum Difference in Iodide Content (mol %) | $\Delta Fog/D_m$ (%) | Proportion of Silver in Each Phase A:B:C |
|---|---|---|---|---|
| I-1 (Comparison) | 0 | 2 | 8.0 | 16.7:0:83.3 |
| III-2 (Invention) | 5 | >95 | 0 | 11.7:5:83.3 |
| III-3 (Invention) | 10 | >95 | 0 | 7.7:9:83.3 |

As can be seen from the results in Table 3, generation of fog due to stress was drastically diminished only if an interface across which there was a large difference in average iodide content was present, irrespective of preparation method.

EXAMPLE 4

Silver halide emulsions were prepared as follows:

To Solution A described in Table 4, which was heated up to 70° C. and stirred thoroughly, were added Solution B and Solution D at the same time, whose compositions are also described in Table 4, at individual rates of 6.65 ml/min over a period of 2 minutes, and the resulting emulsion was physically ripened for 5 minutes (Step 1).

Then, Solution B and Solution C were added simultaneously to the above-described physically ripened emulsion at the same speed over a period of 60 minutes (Step 2).

Thereafter, addition of Solution C was stopped, and Solution B and Solution D were added again at the same time with the same rate over a period of 60 minutes (Step 3).

The thus obtained grains had a three layer structure which was constructed by the first phase made up of pure silver bromide, the second phase made up of silver iodobromide containing 12.2 mol % of silver iodide homogeneously, and the third phase made up of pure silver bromide. The molar ratio of silver among these three phases was 1:30:30. The mean grain diameter was 1.2 μm. Furthermore, five kinds of emulsions were prepared in the same manner as above except that the ratio of an addition time in Step 2 to that in Step 3 was changed in each preparation. Thus, emulsions having molar ratios of silver in the first phase to that in the second phase to that in the third phase, which were 1/60/0, 1/45/15, 1/30/30, 1/15/45, and 1/10/50, respectively, were obtained. Each kind of grains had an average diameter of 1.2 μm, within the range of experimental error. Each emulsion was washed by sedimentation according to a conventional method, and thereto, 65 g of gelatin was added. Further, the resulting mixture was dissolved again by addition of water to finally obtain 1,350 g of emulsion. A 100 g portion of each of these primitive emulsions was adjusted to pH 6.50 and to pAg 8.80, and chemically ripened at 60° C. for 60 minutes by adding thereto $2.0\times10^{-2}$ mg of sodium thio-sulfate and $5.0\times10^{-3}$ mg of chloroauric acid. Thereafter, 80 mg of 4-hydroxy-6-methyl-1,3,3*a*,7-tetraazaindene was added and further 2,4-dichloro-6-hydroxy-s-triazine as a hardener and a proper coating aid were added. The thus prepared emulsion was coated on a polyester support at a coverage of 5 g silver per square meter and at the same time, a gelatin protective layer was provided (at a coverage of 2 g gelatin per square meter), and dried. Samples obtained by coating the above-described emulsions differing in molar ratio of silver between the core and the shell were exposed through an optical wedge, developed with the following Developing Solution A at 26° C. for 2 minutes, fixed, washed and dried. Then, a quantity of developed silver in the $D_{max}$ area was measured using the fluorescent X-ray method, whereby the developement rate to the quantity of coated silver was determined. The results obtained are shown in Table 5.

TABLE 4

| | |
|---|---|
| **Solution A** | |
| Gelatin | 30 g |
| Potassium Bromide | 8 g |
| 3,4-Dimethylthiazoline-2-thione | 80 mg |
| Distilled Water to make | 1 liter |
| **Solution B** | |
| 1.5 N Water Solution of Silver Nitrate | |
| **Solution C** | |
| Potassium Bromide | 173 g |
| Potassium Iodide | 30.4 g |
| Water to make | 1 liter |
| **Solution D** | |
| 1.63 N Water Solution of Potassium Bromide | |
| **Composition of Developing Solution A** | |
| 1-Phenyl-3-pyrazolidone | 0.5 g |
| Hydroquinone | 15 g |
| Disodium Ethylenediaminetetraacetate | 2.0 g |
| Potassium Sulfite | 60.0 g |
| Boric Acid | 4.0 g |
| Potassium Carbonate | 20.0 g |
| Sodium Bromide | 5.0 g |
| Diethylene Glycol | 30.0 g |
| Water to make | 1 liter |
| (pH was adjusted to 10.0 with NaOH) | |

TABLE 5

| Sample No. | Molar Ratio of Silver First Phase/ Second Phase/ Third Phase | Iodide Content in Whole Grain (mol %) | Development Rate (%) |
|---|---|---|---|
| 1 | 1/60/0 | 12 | 62 |
| 2 | 1/45/15 | 9 | 74 |
| 3 | 1/30/30 | 6 | 95 |
| 4 | 1/15/45 | 3 | 100 |
| 5 | 1/10/60 | 2 | 100 |

Fog density due to stress in each of Samples 1 to 5 was sufficiently low.

Moreover, as can be seen from the results in Table 5, the development rate was enhanced when an iodide content in the whole grain was controlled to 10 mol % or less, and it was further heightened when the iodide content in the whole grain was lowered to 6 mol % or less to recover a delay of development which is generally accompanied with a silver halide emulsion of high iodide content.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion comprising silver halide grains which are comprised of silver iodobromide and have a multilayer structure formed by a core and at least one covering layer, and an aspect ratio below 5, said silver halide grains being chemically sensitized and having a halogen composition such that the difference in average iodide content between adjacent layers, each of which has a substantially homogeneous iodide distribution, is not less than 35 mol %, wherein the iodide content in the outermost layer is not more than 40 mol % and in which the overall silver iodide content in said silver halide grains of the multilayer structure is not more than 10 mol %.

2. A silver halide photographic emulsion as in claim 1, wherein the halogen composition of the core of the grains is not more than 40 mol % iodide on the average.

3. A silver halide photographic emulsion as in claim 1, which is a negative emulsion.

4. A silver halide photographic emulsion as in claim 1, which is a positive emulsion.

5. A silver halide photographic emulsion as in claim 1, which has a multilayer structure of from 2 to 5 layers.

6. A silver halide photographic emulsion as in claim 1, wherein the average iodide content in the grain as a whole is not more than 3 mol %, the halogen composition of the core of the grains is from 0 to 20% iodide on the average and wherein the difference in average iodide content between any two adjacent layers in the silver halide grains is not less than 35 mol %.

7. A silver halide photographic emulsion as in claim 1, which has an overall iodide content of not more than 6 mol %.

8. A silver halide photographic emulsion as in claim 1, wherein the cores of said silver halide grains are constituted with silver iodobromide or silver bromide.

9. A silver halide photographic emulsion as in claim 1, wherein the iodide content in the outermost covering layer of said silver halide grains is from 0 to 10 mol %.

10. A silver halide photographic emulsion as in claim 1, wherein said silver halide grains have sizes ranging from 0.5 μm to 10 μm.

11. A silver halide photographic emulsion as in claim 1, wherein the halide composition of a covering layer present in said silver halide grains is silver iodide, silver bromide or silver iodobromide.

12. A silver halide photographic emulsion as in claim 1, wherein the halide composition of the outermost covering layer in said silver halide grains is silver bromide or silver iodobromide.

13. A silber halide photographic emulsion as in claim 1, wherein said silver halide grains are constructed of two layers, and the inner core layer has a higher iodide content than the outer shell layer.

14. A silver halide photographic emulsion as in claim 1, wherein said silver halide grain is constructed of three layers and the core or the intermediate layer covering the core layer has a higher iodide content than the outermost layer.

* * * * *